United States Patent [19]

Perrot et al.

[11] 4,155,756

[45] May 22, 1979

[54] HOLLOW BODIES PRODUCED BY POWDER EXTRUSION OF ALUMINUM-SILICON ALLOYS

[75] Inventors: René Perrot, Voreppe; Jean-Louis Mazodier, Maisons Laffitte, both of France

[73] Assignee: Societe de Vente de l'Aluminium Pechiney, Paris, France

[21] Appl. No.: 860,724

[22] Filed: Dec. 15, 1977

Related U.S. Application Data

[62] Division of Ser. No. 774,424, Mar. 4, 1977, Pat. No. 4,099,314.

[30] Foreign Application Priority Data

Mar. 10, 1976 [FR] France ..... 76 07583

[51] Int. Cl.[2] ..... C22C 1/04; F02F 1/00

[52] U.S. Cl. ..... 75/231; 75/236; 75/243; 75/239; 123/193 C

[58] Field of Search ..... 75/231, 236, 243, 249; 123/193 C, 1 R

[56] References Cited

U.S. PATENT DOCUMENTS

| | | | |
|---|---|---|---|
| 1,944,183 | 1/1934 | Kempf et al. | 75/249 X |
| 2,024,767 | 12/1935 | Jeffries et al. | 75/249 X |
| 3,113,002 | 12/1963 | Hollingsworth | 75/249 X |
| 3,325,279 | 6/1967 | Lawrence et al. | 75/249 X |

FOREIGN PATENT DOCUMENTS

| | | | |
|---|---|---|---|
| 1160194 | 12/1963 | Fed. Rep. of Germany | 75/249 |

OTHER PUBLICATIONS

Dixon, C. F. et al., "Hypereutectic Aluminum-Silicon Alloys Produced by Powder Metallurgy Techniques", In *The International Journal of Powd. Met.*, 1(4):28-36, 1965.

*Primary Examiner*—Richard E. Schafer
*Attorney, Agent, or Firm*—Dennison, Dennison, Meserole & Pollack

[57] ABSTRACT

This invention concerns production by extrusion of hollow cylindrical bodies starting with granulated alloys of aluminum containing silicon. It consists of preparing the composition of the alloy in a liquid form, producing granules by centrifugal pulverization or atomization, introducing the granulated material into an extrusion press to obtain the hollow profile by extrusion and extruding the granular material within to form a cylindrical body. This invention is applicable to form hollow bodies and particularly sleeves of motors of high content silicon aluminum alloy through which size and distribution of primary silicon is improved over traditional casting methods.

2 Claims, 3 Drawing Figures

HOLLOW BODIES PRODUCED BY POWDER EXTRUSION OF ALUMINUM-SILICON ALLOYS

This is a division of application Ser. No. 774,424, filed Mar. 4, 1977, now U.S. Pat. No. 4,099,314, July 11, 1978.

The invention relates to a method of producing hollow bodies in aluminum alloys containing silicon and having improved properties, particularly as regards friction properties, compared with hollow bodies produced from these alloys by prior-art methods. These hollow bodies are for example sleeves of internal combustion engine cylinders, the bodies of hydraulic jacks and, in a general way, any hollow product that has a constant or only slightly variable cross-section over its entire length and that requires good sliding properties.

Such hollow bodies are usually produced by either of two techniques, namely:

a casting technique: this method is used for producing cast-iron automobile engine sleeves, generally by centrifugal casting, and aluminum alloy engine sleeves by pressure-casting;

an extrusion technique: this method is sometimes used for producing the semi-finished products from which aluminum alloy pump bodies are made, the impact-extrusion of cast or cut discs being used.

When aluminum alloys are used for producing these hollow bodies and, more particularly when the products are the sleeves of internal combustion engines, the present tendency is to make use of alloys containing silicon, and, particularly, hypereutectic alloys, i.e. alloys having a silicon content averaging above 12%. This type of alloy is particularly suitable for these uses for two main reasons, namely:

(1) The hypereutectic Al-Si alloys have a lower coefficient of expansion than the other aluminum alloys, and this is clearly of advantage when the parts in question move relatively to each other with a small controlled clearance between them, and when they develop heat during operation.

(2) The presence of hard primary Si crystals in a softer aluminum matrix makes these alloys particularly suitable, with or even without subsequent surface treatment, for providing surfaces having micro-rugosities which favor the retention of lubricants.

However, this eutectic composition is not precisely defined and, because of divergences from equilibrium, crystals of primary silicon always occur in alloys that are very close to being eutectic, such as A-S13 or A-S12 UN, and even in alloys of hypoeutectic composition such as A-S10 UG.

A great difficulty in the manufacture of these parts in alloys containing very large amounts of silicon or having a hypoeutectic structure consists in the fact that the crystals of primary Si should not be too large. The acceptable maximum size is generally 100 micrometers. However, this requirement is difficult to meet in castings, particularly if they are of fairly large dimensions. Also, the silicon crystals in extruded parts are only slightly broken up as compared with the initial cast billet, and the same difficulties still occur.

The applicants have invented a process for preparation of hollow bodies of aluminum alloys containing primary silicon and particularly containing from 12% to 30% silicon and preferably from 15% to 20%, and also from 1% to 5% copper, from 0.5% to 1.5% magnesium, and from 0.5% to 1.5% nickel.

These hollow bodies have the following properties:

the primary silicon is of a size less than 20 microns, whereas the previously used methods have led to these crystals having a size greater than 20 microns;

their porosity is low and is not concentrated in certain zones which could be the cause of mechanical weakness or lack of tightness with respect to fluids under pressure such as is sometimes the case with pressure-cast products;

their ductility is better than that of the conventional cast product;

they have better friction properties than those of the prior art products;

their performance as regards friction can be further improved in comparison with those of the products hitherto used for these purposes, by incorporating in the alloy compounds which promote resistance to wear or reduce the coefficient of friction; and they can be machined much more easily than the products of similar composition produced by the conventional methods.

IN THE DRAWINGS

FIG. 1 shows, at a magnification of 200, a micrograph of a sample taken from a hollow body in an alloy of the A-S17 U4G type (containing approximately 17% of silicon, 4% of copper and 0.5% of magnesium), obtained by powder extrusion. Most of the silicon crystals (in black) have dimensions less than 20 μm.

Figure 1:
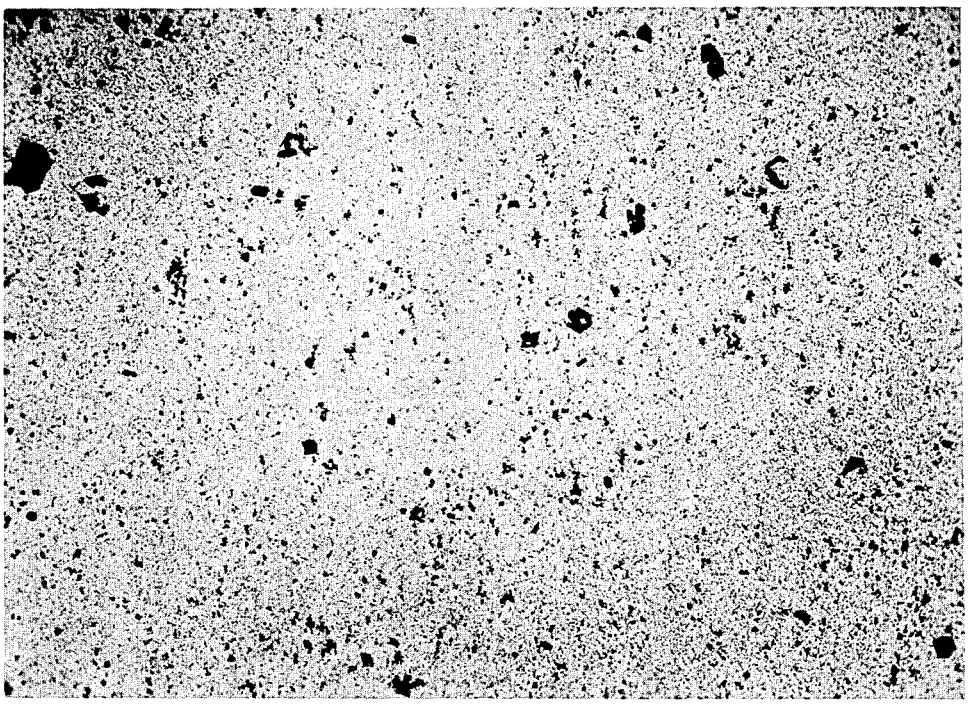

The method of the invention consists in using granules of aluminum alloy obtained by pulverization, in extruding these granules to form hollow bodies and, finally, in machining the hollow bodies thus obtained. The complete system for producing these hollow bodies is therefore as follows:

preparation of ingots of an alloy, for example an alloy of aluminum base containing between 15% and 20% silicon, between 1% and 5% copper, between 0.5% and 1.5% magnesium, and also 0.5% and 1.5% nickel.

remelting of the ingots and granulation of the molten metal thus obtained by any of the existing processes, for example, centrifugal pulverization, atomization or the rotating electrode method; the particle-size of the product thus produced being between 5μm and 2 mm. Depending upon the method of preparation used, the particle-size will vary as will the cooling rate of the particles, resulting in a varying size of the silicon particles. Thus, in the case of granules produced by centrifugal pulverization and having a particle-size of between 300 μm and 2 mm, the size of the primary silicon particles will be between 2 μm and 20 μm, whereas for particles formed by atomization and having a size less than 100 μm, the size of the primary silicon particles will be less than 5 μm;

optional mixing of the granulated alloy material thus obtained with granules of silicon carbide, tin or graphite;

optional isostatic or mechanical compression of the granules;

optional heating to extrusion temperature of the granules which may have been previously compressed;

introduction of the granular material, compressed or otherwise, into the container of the extrusion press;

extrusion of tubing forming the sleeves; this is a conventional extrusion operation for producing hollow bodies and can be carried out using either of the two usual methods well known to the expert in the field:

bridge extrusion; the bridge, located upstream of the die in the path of movement of the metal, secures a mandrel within the die so that the bore of the tube is formed;

extrusion with a plain die and a floating mandrel which advances with the extrusion pad; (it is then necessary to use a hollow slug of compressed granular material which has an axial hole formed therein in which the mandrel is accommodated during extrusion);

optional dressing and sizing;

optional stabilization heat-treatment; and removal of material from inside the tubes, and machining.

It is important to point out that certain of the succession steps constituting the above-described system are optional:

the mixing of the granulated alloy material with granules of silicon carbide, tin or graphite is for the purpose of imparting to the hollow bodies, subsequently formed by extrusion, special degrees of hardness (silicon carbide) or good sliding properties (tin or graphite);

the precompression of the granular material is not essential either. This precompression may be carried out either cold or hot with the possible use of varying negative pressure so as to facilitate the suppression of porosity in the extruded product.

The hollow bodies produced in accordance with the above-described method have a certain number of notable properties. First, their friction characteristics are distinctly improved, compared with those of the known products. In the examples detailed below for illustrating the invention, the experimental method whereby this improvement can be shown is indicated.

This improvement involves obtaining a particularly fine product structure. The size of the crystals of primary silicon is less than 20 microns and, by selecting the appropriate production method, can be kept below 5 microns. With conventional casting methods, such as pressure casting or low-pressure casting, the size varies between 20 and 80 microns.

In FIG. 1, the micrograph is of a sample from a hollow body in an alloy of the A-S17U4G type (containing approximately 17% of silicon, 4% of copper and 0.5% of magnesium), obtained by powder extrusion. Most of the silicon crystals (in black) have dimensions less than 20 μm.

Figure 2:
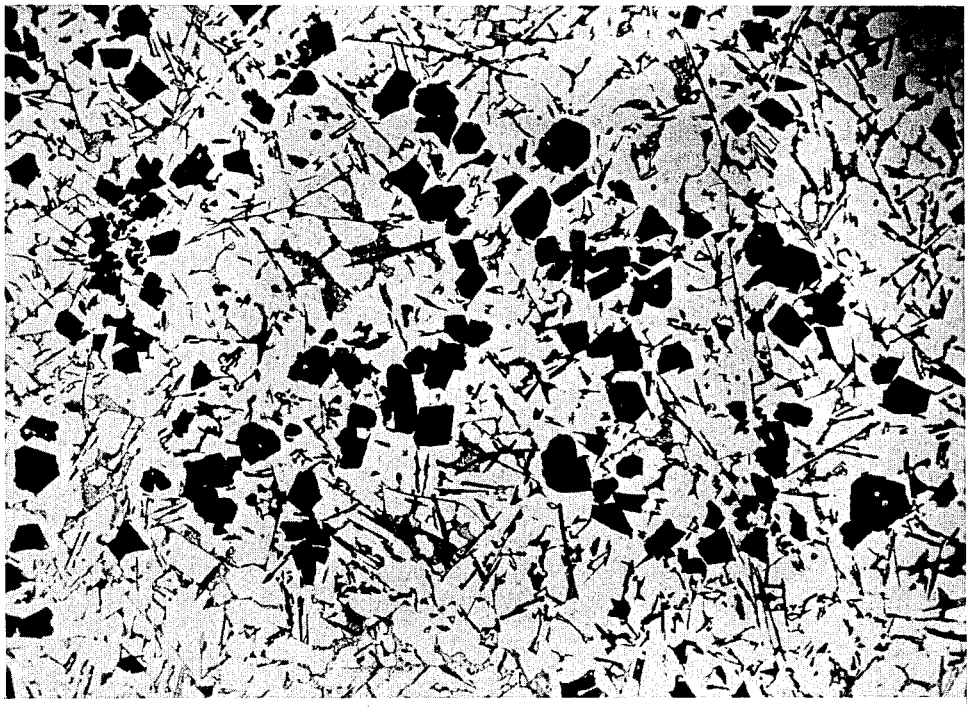
FIG. 2 shows, at the same magnification of 200, a micrograph of a sample taken from a hollow body made of the same alloy but obtained by low-pressure casting. The difference in the size of the crystals can be clearly seen.

In FIG. 2, the micrograph is of a sample taken from a hollow body made of the same alloy but obtained by low-pressure casting. The difference in the size of the crystals can be clearly seen.

The improvement also involves the presence of fine, uniformly distributed pores promoting lubrication by creating zones to retain oil. In cast products the pores are distributed unevenly and may occur in very great numbers in localized zones.

The improvement further involves the possible presence in the matrix of compounds such as silicon carbide, tin or graphite which improve resistance to wear or reduce the coefficient of friction.

Secondly, parts obtained by the method of the invention have a remarkable wear behavior distinctly better than that of alloys of similar composition worked by conventional methods. This behavior is revealed in excellent chip formation, good surface and in particular, light tool-wear. This good behavior results from the absence of crystals of primary silicon of large size, the effect of which is vary damaging in machining operations.

In the third place, the product obtained has fine, well distributed pores. Thus, there are no areas of reduced mechanical strength or areas which can be penetrated by fluids under pressure such as occur in pressure-cast products.

On the other hand, this product has distinctly greater plastic range, i.e. difference between tensile strength and yield strength, of 15 hbars and elongation of 5%, than that of cast products wherein elasticity is virtually non-existent as indicated by the elastic limit (in the order of 0.5 hbar) and elongations of less than 1%.

To summarize, the hollow bodies made by powder-extrusion are notable, from the metallurgical point of view, because of the size of the crystals of primary Si being less than 20 μm, small, evenly distributed pores and the alignment of constituents that is characteristic of the special texture of all extruded products. Furthermore, their oxygen content, resulting from the surface oxidation of the granulated material, is between 100 ppm and 15000 ppm.

Also, the method of the invention has a number of features which enable the production procedure and the finishing operations on these hollow bodies to be considerably simplified. The provision, by extrusion, of a product having dimensions very close to the final dimensions and possessing a good surface condition is a considerable advantage over the casting methods which call for considerable machining to bring the product to the required dimensions and surface condition; the greater ease in machining the powder-extruded products, as compared with products obtained by impact-extrusion or pressure casting, enables machining to be carried out more economically and tool-wear to be reduced; and the use of either alloys having a composition and structure not obtainable by existing methods, or composite products consisting of the basic alloy and additions, such as silicon carbide, tin and graphite, makes it possible, in most cases where the products are used as sliding parts, to dispense with the surface treatments that have sometimes been necessary in the past.

In certain cases however, it will be advantageous to carry out a chemical treatment of the surface following a polishing or grinding operation. The object of this treatment is to smooth out the crystals of primary silicon over which a part will rub when moving relatively to the hollow body.

The following Examples serve to illustrate the invention and to make it more readily understood.

EXAMPLE I

Internal combustion engine sleeves were produced by the following succession of operations:

(a) Preparation of an A-S17U4G alloy having the composition:

| | | |
|---|---|---|
| Si | = | 16.80% |
| Cu | = | 4.40% |
| Mg | = | 0.55% |
| Fe | = | 0.80% |
| Al | = | remainder |

and refining of the primary Si by the addition of phosphorous in accordance with a known technique.

(b) Production of the granulated material.

The cast metal was brought to a temperature of approximately 850° C.; it was held at this temperature for 30 minutes and then pulverized by centrifuging. The size of the particles thus obtained was between 50 μm and 2 mm. The structure of the particles thus obtained was fine; the crystals of primary silicon were of a size varying between 2 μm and 20 μm maximum.

(c) Powder-extrusion of tubes to be used as sleeves; this operation was carried out in the following manner:

The extrusion press was a conventional press equipped with bridge tools. Without having been heated or precompressed, the granulated material was introduced into the container of the extrusion press in a loose mass; the container and the tools were not lubricated but were heated to a temperature of approximately 450° C.; to prevent the granulated material from flowing through the die during charging of the container, an aluminum foil was placed in front of the die. The extrusion pad was then fitted at the inlet to the container; the ram was applied so as to compact the granulated material; the pressure applied to the ram was increased until it was sufficient to cause the metal to flow through the die after the granulated material had been completely compacted. This metal-flow sufficed to ensure compactness in the extruded product and cohesion between the particles of the initial material; this flow in fact enables the oxide layer on the surface of the particles to be broken and thus creates metallic surfaces, completely free from oxide, that could readily fuse together when brought into contact with each other.

(d) Dressing of the tube by a conventional drawing operation.

(e) Cutting of the tube into lengths corresponding to those of the sleeves.

(f) Stabilization heat-treatment for several hours at a temperature of 220°–250° C. (this temperature being higher than that to which the products are subjected when in use).

(g) Machining of the sleeves to the final dimensions.

The sleeves thus obtained had a very fine metallurgical structure similar to that illustrated in FIG. 1.

The mechanical properties were measured by means of tensile tests carried out on test-pieces cut in the direction of extrusion (L) and in the direction transverse thereto (T). For comparison purposes, the mechanical properties of the same alloy, pressure-cast, and of cast-iron are given:

| | Direction | B.L. hbars | El. % $5.65\sqrt{SO}$ |
|---|---|---|---|
| A-S17U4G powder-extruded | L | 26.6 | 5.0 |
| | T | 25.2 | 3.7 |
| A-S17U4G pressure-cast | | 29.0 | <1.0 |
| Cast-iron | | 20 to 40 | <1.0 |

B.L. = breaking load (in hectobars)
El. = elongation measured on the basis of $5.65\sqrt{So}$
So = cross-section of test-piece It was observed that with a breaking load approximating very closely to that of A-S17U4G, pressure-cast, and of cast-iron, the elongation values recorded for extruded A-S17U4G are higher, which indicates a much reduced brittleness.

Figure 3:
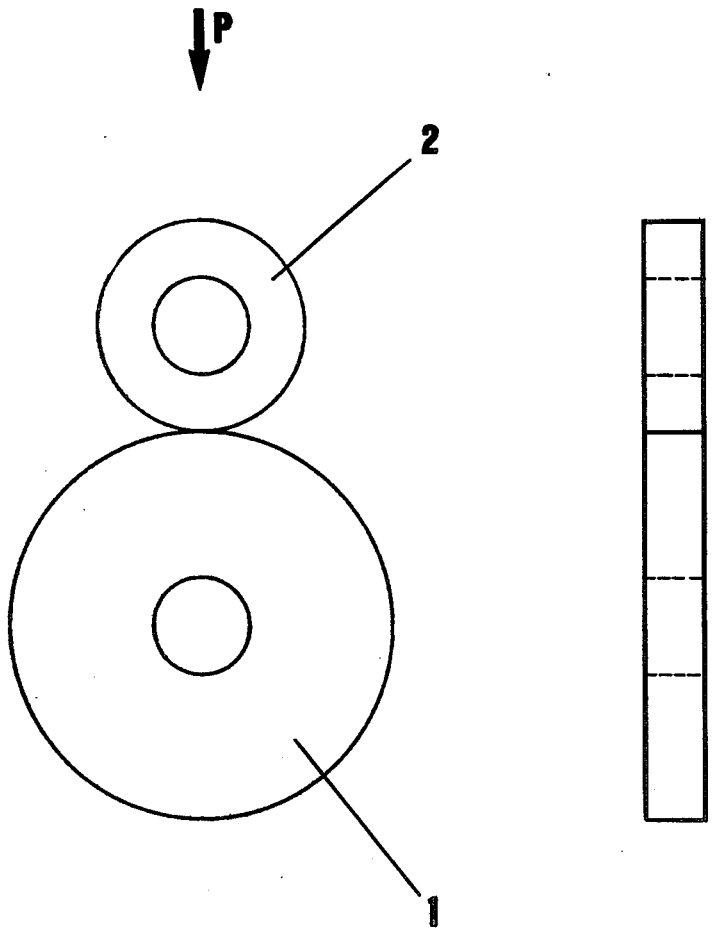
FIG. 3 shows, in elevation and side view, slide test pieces in the form of two tangent discs.

Sliding behavior was determined by a simulation test carried out in the following manner. The slide test-piece took the form of two tangent discs as shown in FIG. 3 (shown in elevation on the right and in side-view on the left). The discs were caused to rotate so as to cause a 10% pure slip (in angular speed) between the two test-pieces in contact; oil at a constant pressure was introduced at the zone of contact, and during the test the following could be measured; the load P applied to the upper disc, the contact temperature, and the frictional torque.

The test-pieces were annular discs, having a thickness of 10 mm and an inside diameter of 16 mm.

The lower disc, in A-S12UN had an outside diameter of 65 mm and was used as a reference (numeral 1 in the drawing).

The other disc was made of the test metal and had an outside diameter of 35 mm (numeral 2 in the drawing).

The sliding tests were carried out in two stages; first stage, seizing test; second stage, wear test. Each of these two tests started with a running-in period.

Seizing Test

After a running-in period during which the two samples were placed in contact with each other under a relatively low load and in which the discs were rotated at constant speed, this test consisted in periodically increasing the load until seizing occurred, this mainly manifesting itself during the test by a sudden increase in the contact temperature, and by an increase and, in particular, destabilization of the coefficient of friction. The load being applied at the moment when seizing occurred was called the "gripping load".

Wear Test

This test, was preceded by a running-in operation identical to that used in the seizing test, and it consisted in carrying out a sliding test using a constant load equal to 0.5 to 0.8 times the seizing load and applied for a period of 2 to 5 hours, and in measuring the loss in weight of the test-pieces during the course of the test.

The results of these sliding tests as shown in the following table wherein the values recorded for the powder-extruded alloy, the pressure-cast alloy, the alloy cast under low pressure and cast-iron are compared:

| | Seizing load daN | Coefficient of friction at P = daN | wear in mg: Disc in A-S12UN | wear in mg: Disc in A-S17U4G or cast-iron |
|---|---|---|---|---|
| A-S17U4G powder-extruded | 90 | 0.015 | 67 | 8 |
| A-S17U4G pressure-cast | 80 | 0.015 | 52 | 12 |
| A-S17U4G cast under low-pressure | 30 | 0.045 | — | — |
| cast-iron | 80 | 0.109 | 2 100 | 0.5 |

This test showed that the behavior of powder-extruded A-S17U4G is comparable with that of the pressure-cast alloy A-S17U4G as regards the seizing loads, the coefficient of friction and the wear on the parts. On the other hand, the behavior of the product produced by powder-extrusion is markedly superior to that of the same alloy, cast under low pressure, which has an appreciably lower seizing load and a higher coefficient of friction than in the two other cases. The behavior is also considerably better than that of cast-iron which, for an identical seizing load, has a higher coefficient of friction and as regards which the wear of the contacting part in aluminum alloy occurs more rapidly.

EXAMPLE II (a) Preparation of an A-S25U4G alloy having the composition:

| | | |
|---|---|---|
| Si | = | 25% |
| Cu | = | 4.3% |
| Mg | = | .65% |
| Fe | = | 0.8% |
| Al | = | remainder |

and refining of the primary Si by addition of phosphorous in accordance with a known technique.

(b) Production of the granulated material.

The cast metal was raised to a temperature of approximately 900° C. and was held at this temperature for 30 minutes and then pulverized by atomization. The size of the particles thus obtained was between 5 μm and 500 μm. Only those particles having a size of less than 100 μm were retained. The structure of the particles thus produced was fine; the crystals of primary silicon had a size of less than 5 μm.

(c) Cold compacting.

The granulated material was compacted cold in a vertical press and under a pressure of 50 kg/mm$^2$.

(d) Extrusion of tubes for use as sleeves.

This operation was carried out on a conventional press provided with bridge-type tools. The compacted slug was extruded without heating, as a conventional solid billet.

(e) Dressing of the tube.

This was done by a conventional drawing operation.

(f) Cutting of the tube into lengths corresponding to the length of the sleeves.

(g) Stabilization heat-treatment for several hours at 220° C.-250° C. (which temperature is higher than that at which the sleeves are used), or solution heat-treatment, quenching and tempering.

(h) Machining of the sleeves to the final dimensions.

The metallurgical structure of the sleeves thus obtained was very fine, and the size of the silicon crystals was less than 5 μm. It was also observed, after heat-treatment, that the pores were very fine and evenly distributed in the product.

The mechanical properties, measured in the same way as in the previous Example, are shown in the following table:

Sleeves in A-S25U4G produced by powder-extrusion:

| | Direction | B.L. hbars | El. % $5.65\sqrt{So}$ |
|---|---|---|---|
| | L | 29 | 4 |
| Stabilized | T | 28 | 2.5 |
| In solution | L | 55 | 2 |
| quenched and tempered | T | 52 | 0.7 |

It will be seen that the material exhibits high breaking loads associated with quite considerable elongations.

Regarding the sliding properties, the same simulation tests were carried out as in Example I.

The performances of this alloy were identical to those of A-S17U4G, shaped by powder-extrusion of low-pressure casting, as regards the seizing load and the coefficient of friction; on the other hand, wear resistance is appreciably increased; loss in weight per unit of time is reduced in a ratio of 1.5 to 1.0.

What is claimed is:

1. A hollow body, such as an internal combustion engine sleeve, produced by powder extrusion of aluminum-silicon alloy with a silicon content between 15% and 20%, having improved friction and wear properties and presenting a micrographic structure characterized by crystals of primary silicon of 2 to 20 micrometers, particles of hardening and anti-friction constituents selected from the group consisting of silicon carbide, tin and graphite, fine uniformly distributed pores for promoting lubrication by providing zones for retaining lubricant, and an oxygen content between 100 and 15,000 ppm.

2. A hollow body as in claim 1, wherein the aluminum-silicon alloy contains from 15% to 20% silicon, from 1% to 5% copper, from 0.5% to 1.5% magnesium, and also from 0.5% to 1.5% nickel.

* * * * *